US012059587B2

(12) United States Patent
Gore

(10) Patent No.: US 12,059,587 B2
(45) Date of Patent: Aug. 13, 2024

(54) BOX RACK WITH FUNCTIONAL TRAINING DEVICES

(71) Applicant: Recreation Supply, Inc., Lewis Center, OH (US)

(72) Inventor: Alan Gore, Lewis Center, OH (US)

(73) Assignee: Recreation Supply, Inc., Lewis Center, OH (US)

( * ) Notice: Subject to any disclaimer, the term of this patent is extended or adjusted under 35 U.S.C. 154(b) by 301 days.

(21) Appl. No.: 17/466,638

(22) Filed: Sep. 3, 2021

(65) Prior Publication Data

US 2021/0394003 A1 Dec. 23, 2021

Related U.S. Application Data

(63) Continuation of application No. 16/116,469, filed on Aug. 29, 2018, now Pat. No. 11,110,313.

(51) Int. Cl.
*A63B 21/00* (2006.01)
*A63B 21/078* (2006.01)

(52) U.S. Cl.
CPC ..... *A63B 21/00047* (2013.01); *A63B 21/00065* (2013.01); *A63B 21/0783* (2015.10); *A63B 21/156* (2013.01); *A63B 21/4035* (2015.10); *A63B 2225/10* (2013.01)

(58) Field of Classification Search
CPC ..... A63B 21/00047; A63B 21/00065; A63B 21/0783; A63B 21/156; A63B 21/4035; A63B 2225/10; A63B 23/1218; A63B 2022/0079; A63B 21/078; A63B 21/154; A63B 23/03541; A63B 23/03566; A63B 23/1209; A63B 21/0628; A63B 1/00
See application file for complete search history.

(56) References Cited

U.S. PATENT DOCUMENTS

| | | | |
|---|---|---|---|
| 5,215,510 | A | 6/1993 | Baran |
| 5,669,859 | A | 9/1997 | Liggett et al. |
| 6,394,935 | B1 | 5/2002 | Lake |
| 7,131,937 | B2 | 11/2006 | Skilken et al. |
| 7,488,277 | B1 | 2/2009 | Knapp |
| 7,654,942 | B1 | 2/2010 | Batca |
| 7,666,124 | B2 | 2/2010 | Vaes |
| 7,837,600 | B1 | 11/2010 | Habing |
| 8,870,718 | B2 | 10/2014 | Habing |
| 9,050,496 | B2 | 6/2015 | Towley, III et al. |
| 2001/0034290 | A1 | 10/2001 | Tolles |
| 2002/0091043 | A1 | 7/2002 | Rexach |
| 2002/0147086 | A1 | 10/2002 | Walsh |

(Continued)

FOREIGN PATENT DOCUMENTS

CN 201949544 U 8/2011

OTHER PUBLICATIONS

Bodycraft, F430 Power Rack for Free Weights, 1999, pp. 1-9, USA.

(Continued)

*Primary Examiner* — Sundhara M Ganesan
(74) *Attorney, Agent, or Firm* — Standley Law Group LLP; Jeffrey S. Standley; Adam J. Smith

(57) ABSTRACT

An exercise apparatus includes a squat rack comprising a number of members forming a cage, a resistance device associated the said squat rack, a cable pull device attached to one of said number of members, and a cable connecting the resistance device to the cable pull device, where the cable extends along one or more of the number of members such that sides of the cage are unobstructed by the cable.

24 Claims, 7 Drawing Sheets

(56) References Cited

U.S. PATENT DOCUMENTS

| | | | |
|---|---|---|---|
| 2008/0287270 | A1 | 11/2008 | Carter |
| 2013/0184128 | A1 | 7/2013 | Towley, III et al. |
| 2013/0203565 | A1 | 8/2013 | Floyd |
| 2013/0274075 | A1 | 10/2013 | Habing et al. |
| 2014/0080685 | A1 | 3/2014 | Butler |
| 2015/0246258 | A1 | 9/2015 | Hockridge |
| 2017/0007877 | A1 | 1/2017 | Leipheimer |
| 2017/0216656 | A1 | 8/2017 | Leipheimer |
| 2018/0200563 | A1 | 7/2018 | Hansen et al. |
| 2018/0353795 | A1 | 12/2018 | Ostmeyer et al. |
| 2019/0240525 | A1 | 8/2019 | Leipheimer |
| 2019/0336812 | A1 | 11/2019 | Leipheimer |

OTHER PUBLICATIONS

Bodycraft, Xpress, Sep. 9, 2020, pp. 1-2, USA https://web.archive.org/web/20040205104236/https://www.bodycraft.c.

Bodycraft, Xpress Strength Training System Instruction Manual, Sep. 11, 2020, pp. 1-13, Sunbury, Ohio USA.

FT2, Inspire Assembly & Operation Manual, Nov. 2012, pp. 1-33, Anaheim, CA USA.

Bodycraft, Xpress Pro, Sep. 11, 2020, pp. 1-2, Sunbury, Ohio USA.

Health in Motion, SCS-202 Inspire, Smith Cage System Option-2 Assembly and Operation Manual, pp. 1-36, Nov. 15, 2014, www.inspirefitness.net, Anaheim, CA.

Straydog Strength, Cable Column Attachment, pp. 1-3, https://straydogstrength.com/product/cable-column-attachment/, Newark, Ohio.

USA Home Gym, Equipment, Smith Machine, Inspire Fitness SCS Smith Cage System Review, pp. 1-8, Aug. 4, 2014, https://www.USA-homegym.com/equipment/inspire-fitness-scs-smith-cage-system/, USA.

amazon.com, Inspire Fitness SCS Smith System Fully Loaded with Bench and Attachments—Functional Trainer Home Gym with Smith Machine, Bench, Preacher Curl Attachment, and Leg Extension_Leg Curl Attachment Sports & Outdoors, pp. 1-9, Aug. 16, 2023, USA.

Planted, Inspire SCS Frequently Asked Questions, https://www.youtube.com/watch?v=5aRKiyksEfQ, 1 page, Sep. 9, 2020, Lafayette, CA, USA.

BOX RACK WITH FUNCTIONAL TRAINING DEVICES

CROSS-REFERENCE TO RELATED APPLICATION

This application is a continuation of U.S. application Ser. No. 16/116,469 filed Aug. 29, 2018, the disclosures of which are hereby incorporated by reference as if fully restated herein.

TECHNICAL FIELD

Exemplary embodiments of the present invention relate generally to a box rack with functional training devices.

BACKGROUND AND SUMMARY OF THE INVENTION

Box racks exist which facilitate the movement of a user through various exercises. Such box racks are generally rectangular cages which surround the user while the user moves a weight through one or more free weight exercises. Such box racks may facilitate, for example without limitation, lateral rows, dips, squats, bench press, and other exercises. One exemplary box rack is the F430 Power Rack from BODYCRAFT® available at https://www.bodycraft-.com/f430-power-rack.html.

In recent years, functional weight lifting exercises have increased in popularity. These exercises are intended to better emulate real world, practical uses of the muscles by engaging multiple muscle groups when performing an exercise instead of isolating a particular muscle or muscle group. One might compare a bicep curl, which is intended to engage the bicep, with a chin-up, which engages the biceps, shoulders, and back muscles, among others.

Users are increasingly seeking machines capable of providing the user with multiple exercise options. Therefore, what is needed is a box rack which incorporates functional training devices.

The present invention is a box rack which incorporates functional training devices. The box rack may comprise a number of vertical and horizontal members shaped into a substantially rectangular frame. The box rack may be configured to surround a user performing a free weight exercise. A first and second functional training device may each be mounted to one of the vertical members in a slidable arrangement. A third functional training device may be located on an upper portion of the box rack and configured to be pulled downward. A fourth functional training device may be located on a lower portion of the box rack and configured to be pulled outward or upward.

The first and third functional training devices may be connected to one another as well as a first resistance device by a first cable. The second and third functional training devices may be connected to one another as well as a second resistance device by a second cable. The first functional training device may be connected to the fourth functional training device by a third cable. The second functional training device may be connected to the fourth functional training device by a fourth cable.

Further features and advantages of the devices and systems disclosed herein, as well as the structure and operation of various aspects of the present disclosure, are described in detail below with reference to the accompanying figures.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Embodiments of the invention are described herein with reference to illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Figure 1:
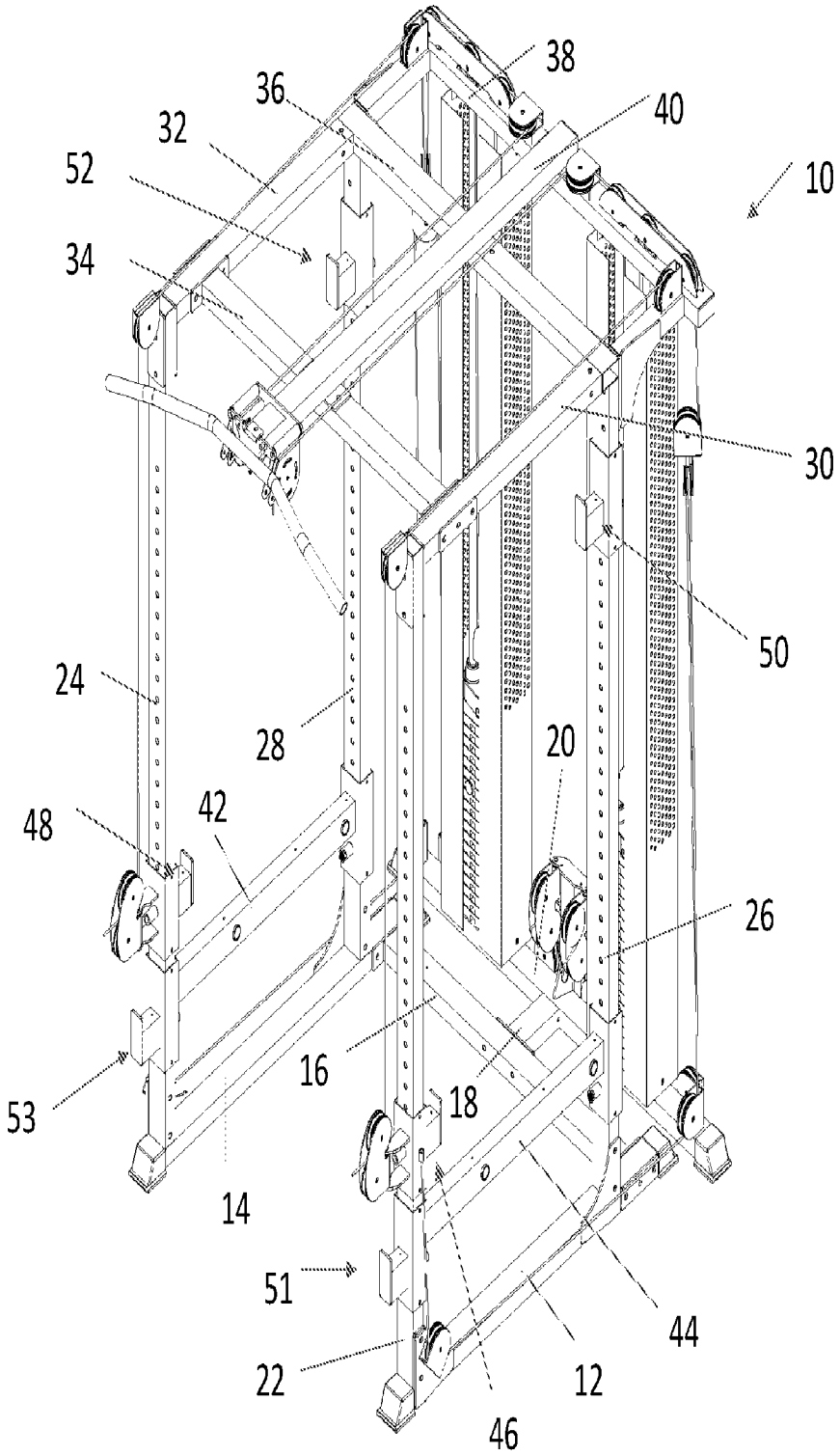
FIG. 1 a front perspective view of an exemplary exercise machine in accordance with the present invention.

FIG. 1 a front perspective view of an exemplary exercise machine 10. The exercise machine 10 may comprise a first base member 12, a second base member 14, and a third base member 16. The first base member 12 may be spaced apart from and extend substantially parallel with the second base member 14. The third base member 16 may extend between the first and second base members 12 and 14. In exemplary embodiments, the third base member 16 extends between distal ends of the first and second base members 12 and 14.

A fourth base member 20 may be spaced apart from and extend substantially parallel with the third base member 16. In exemplary embodiments, the fourth base member 20 is located behind the third base member 16. The fourth base member 20 may extend substantially the length of the third base member 16 and may extend therebeyond. A connector 18 may extend between the third base member 16 and the fourth base member 20. In exemplary embodiments, the connector may extend substantially perpendicular to the third base member 16 and the fourth base member 20.

A first vertical member 22 and a third vertical member 26 may extend substantially perpendicular from the first base member 12. In exemplary embodiments, the first and second vertical members 22 and 26 may extend substantially parallel with one another. The first vertical member 22 may extend from a proximal end of the first base member 12. The third vertical member 26 may extend from a distal end of the first base member 12. However, any location of the first and third vertical member 22 and 26 are contemplated.

Similarly, a second vertical member 24 and a fourth vertical member 28 may extend substantially perpendicular from the second base member 14. In exemplary embodiments, the second and fourth vertical members 24 and 28 may extend substantially parallel with one another. The second vertical member 24 may extend from a proximal end of the second base member 14. The fourth vertical member 28 may extend from a distal end of the second base member 14. However, any location of the second and fourth vertical member 24 and 28 are contemplated.

A first upper member 30 may extend between the first and third vertical member 22 and 26. In exemplary embodiments, the first upper member 30 may be connected to a distal end of the first and third vertical members 22 and 26. The first upper member 30 may extend beyond the third vertical member 26.

Similarly, a second upper member 32 may extend between the second and fourth vertical members 24 and 28. In exemplary embodiments, the second upper member 32 may be connected to a distal end of the second and fourth vertical members 24 and 28. The second upper member 32 may extend beyond the fourth vertical member 28.

A third upper member 34 may extend between the first upper member 30 and the second upper member 32. A fourth upper member 36 may extend between the first upper member 30 and the second upper member 32. A fifth upper member 38 may extend between the first upper member 30 and the second upper member 32. In exemplary embodiments, the third, fourth, and fifth upper members 34, 36, and 38 may be spaced apart from one another and extend substantially parallel to one another. A sixth upper member 40 may extend between the third, fourth, and fifth upper members 34, 36, and 38. In exemplary embodiments, the sixth upper member 40 may extend substantially parallel with the first and second upper members 30 and 32. The sixth upper member 40 may be located halfway between the first and second upper member 30 and 32, though such is not required. The sixth upper member 40 may extend along or on the third, fourth, and fifth upper members 34, 36, and 38.

At least the first, second, and third base members 12, 14, 16, the first, second, third, and fourth vertical members 22, 24, 26, and 28, and the first, second, third, and fourth upper members 30, 32, 34, and 36 may form a substantially rectangular cage. Stated another way, these components may form a box rack.

A first safety rail 42 may extend between the second and fourth vertical members 24 and 28. A second safety rail 44 may extend between the first and third vertical members 22 and 26. In exemplary embodiments, the first, second, third, and fourth vertical members 22, 24, 26, and 28 may comprise a series of apertures. The first and second safety rails 42 and 44 may be mounted to the respective vertical members 22, 24, 26, and 28 in a slidable arrangement. The first and second safety rails 42 and 44 may comprise removable pins configured to temporarily secure the first and second safety rails 42 and 44 at various vertical locations along the first, second, third, and fourth vertical members 22, 24, 26, and 28.

A first holding device 46 may be mounted to the first vertical member 22 in a slidable arrangement. A second holding device 48 may be mounted to the second vertical member 24 in a slidable arrangement. In exemplary embodiments, the first and second holding devices 46 and 48 may be hooks configured to receive a bar, such as a bar used to perform box squats, bench press, curls, rows, and the like. The first and second holding devices 46 and 48 may be mounted to the inside of the first and second vertical members 22 and 24, respectively, such that the respective holding device 46 and 48 faces the rear of the exercise machine 10. The first and second holding devices 46 and 48 may comprise pins configured to temporarily secure the first and second holding devices 46 and 48 at various vertical locations along the first and second vertical members 22 and 24 by engaging the apertures located in the first and second vertical members 22 and 24.

Similarly, a third holding device 50 may be mounted to the third vertical member 26 in a slidable arrangement. A fourth holding device 52 may be mounted to the fourth vertical member 28 in a slidable arrangement. In exemplary embodiments, the third and fourth holding devices 50 and 52 may be hooks configured to receive a bar, such as a bar used to perform box squats, bench press, curls, rows, and the like. The third and fourth holding devices 50 and 52 may be mounted to the inside of the third and fourth vertical members 26 and 28, respectively, such that the respective holding device 50 and 52 faces the front of the exercise machine 10. The second and third holding devices 50 and 52 may comprise pins configured to temporarily secure the second and third holding devices 50 and 52 at various vertical locations along the third and fourth vertical members 26 and 28 by engaging the apertures located in the third and fourth vertical members 26 and 28.

A fifth holding device 51 may be mounted to the first vertical member 22 in a slidable arrangement. A sixth holding device 53 may be mounted to the second vertical member 24 in a slidable arrangement. In exemplary embodiments, the fifth and sixth holding devices 51 and 53 may be hooks configured to receive a bar, such as a bar used to perform box squats, bench press, curls, rows, and the like. The fifth and sixth holding devices 46 and 48 may be mounted to the outside of the first and second vertical members 22 and 24, respectively, such that the respective holding device 51 and 53 faces the front of the exercise machine 10. The fifth and sixth holding devices 51 and 53 may comprise pins configured to temporarily secure the fifth and sixth holding devices 51 and 53 at various vertical locations along the first and second vertical members 22 and 24 by engaging the apertures located in the first and second vertical members 22 and 24.

The number and arrangement of the holding devices 46, 48, 50, 51, 52, and 53 is merely exemplary and is not intended to be limiting. Any number of holding devices 46, 48, 50, 51, 52, and 53 located along any or all of the first, second, third, and fourth vertical members 22, 24, 26, and 28 are contemplated.

Figure 2:
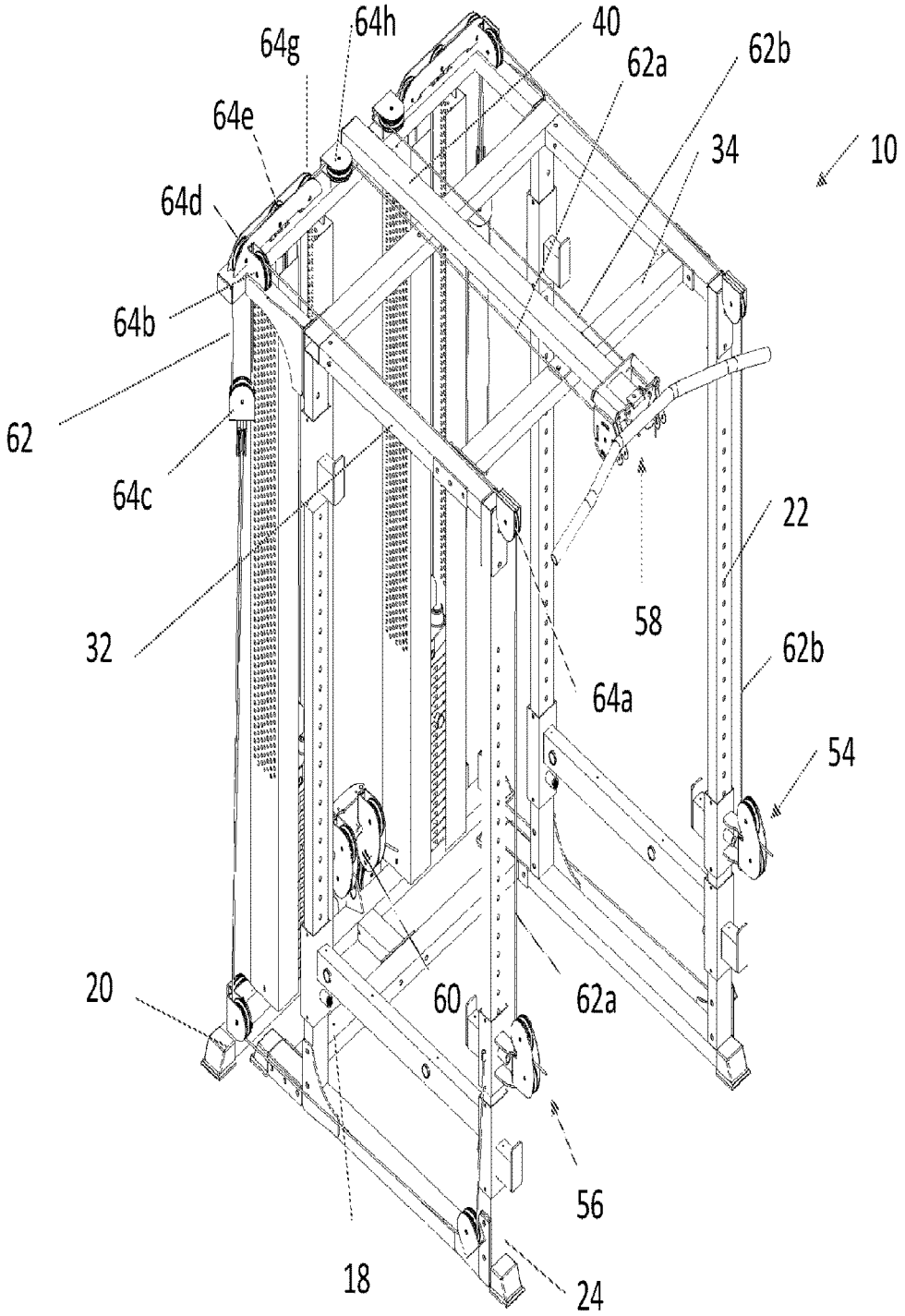
FIG. 2 is another front perspective view of the exercise machine of FIG. 1.

FIG. 2 is another front perspective view of the exercise machine 10. A first functional training device 54 may be mounted to the first vertical member 22 in a slidable arrangement. A second functional training device 56 may be mounted to the second vertical member 24 in a slidable arrangement. The first and second training devices 54 and 56 may comprise pins configured to temporarily secure the first and second training devices 54 and 56 at various vertical locations along the first and second vertical members 22 and 24 by engaging the apertures located in the first and second vertical members 22 and 24. In exemplary embodiments, the first functional training device 54 may be connected to, or integrally formed with, the first holding device 46, though such is not required. Similarly, in exemplary embodiments the second functional training device 56 may be connected to, or integrally formed with, the second holding device 48, though such is not required.

A third functional training device 58 may be mounted to a distal end of the sixth upper member 40. In other exemplary embodiments, the third functional training device 58 may be mounted to the third upper member 34. The third functional training device 58 may be a pull-down bar, though such is not required. Put more simply, the third functional training device 58 may be located on an upper portion of the box rack and configured to be pulled downward.

A fourth functional training device 60 may be mounted to the fourth base member 20. In other exemplary embodiments, the fourth functional training device 60 may be mounted to the third base member 16. The fourth functional training device 60 may be a rowing device, though such is not required. Put more simply, the fourth functional training device 60 may be located on a lower portion of the box rack and configured to be pulled upward or outward.

In exemplary embodiments, the functional training devices 54, 56, 58, and 60 may be cable pull devices. The functional training devices 54, 56, 58, and 60 may be fixed or may be configured for swiveling movement. The functional training devices 54, 56, 58, and 60 may comprise one or more pulleys configured to secure a cable 62*a*, 62*b*, 62*c*, or 62*d* and permit a user to pull on the cable 62*a*, 62*b*, 62*c*, or 62*d*, or attachment device (e.g., handle, bar, rope, etc.) connected thereto, and move through various exercises. As will be explained in greater detail herein, the cables 62*a*, 62*b*, 62*c*, and 62*d* may be connected to resistance devices 66*a* and 66*b*. The cables 62*a*, 62*b*, 62*c*, and 62*d*, may further comprise stoppers and/or attachment devices configured to prevent the cable 62*a*, 62*b*, 62*c*, or 62*d* from traveling beyond the respective functional training devices 54, 56, 58, and 60.

A first cable 62*a* may extend from the second functional training device 56 to a first resistance device 66*a* and on to the third functional training device 58. The first cable 62*a* may travel vertically upwards along the second vertical member 24 until engaging a first pulley 64*a*. The first pulley 64*a* may be located on or along the second vertical member 24 or the second upper member 32. In other exemplary embodiments, the first pulley 64*a* may be located on a member extending from the second upper member 32. The first cable 62*a* may then travel horizontally along the second upper member 32 until engaging the second pulley 64*b*. The second pulley 64*b* may be located on or along the second upper member 32. The first cable 62*a* may then travel vertically downwards until engaging a third pulley 64*c* and then reversing directions, traveling vertically upwards until engaging a fourth pulley 64*d*. As will be discussed in greater detail herein, the third pulley 64*c* may be attached to a tenth pulley 64*k* connected to a third cable 62*c*. The first cable 62*a* may then travel horizontally along the fifth upper member 38 before engaging a fifth pulley 64*e*. The first cable 62*a* may then travel vertically downwards until engaging a sixth pulley 64*f* located on, or otherwise connected to, the first resistance device 66*a*.

The first cable 62*a* may then reverse directions, traveling vertically upwards until engaging a seventh pulley 64*g*. The first cable 62*a* may then travel horizontally along the fifth upper member 38 until engaging an eighth pulley 64*h*. The fourth, fifth, seventh, and eighth pulleys 64*d*, 64, 64*g*, and 64*h* may be located on or along the fifth upper member 38. The first cable 62*a* may then travel horizontally along the sixth upper member 40 before terminating at or near the third functional training device 58.

A similar or identical arrangement may be located along the other side of the exercise machine 10 such that a second cable 62*b* travels between the first functional training device 54, the second resistance device 66*b*, and the third functional training device 58. It is notable that as the first and second cable 62*a* and 62*b* may both be connected to the third functional training device 58. A single attachment device of the third functional training device 58 may be connected to both the first and second cables 62*a* and 62*b* such that the first and second resistance device 66*a* and 66*b* are engaged when the attachment device is moved. In other exemplary embodiments, individual attachment devices of the third functional training device 58 may be connected to each of the first and second cables 62*a* and 62*b* separately such that the first and second resistance device 66*a* and 66*b* are separately engaged when the respective attachment device is moved.

Figure 3:
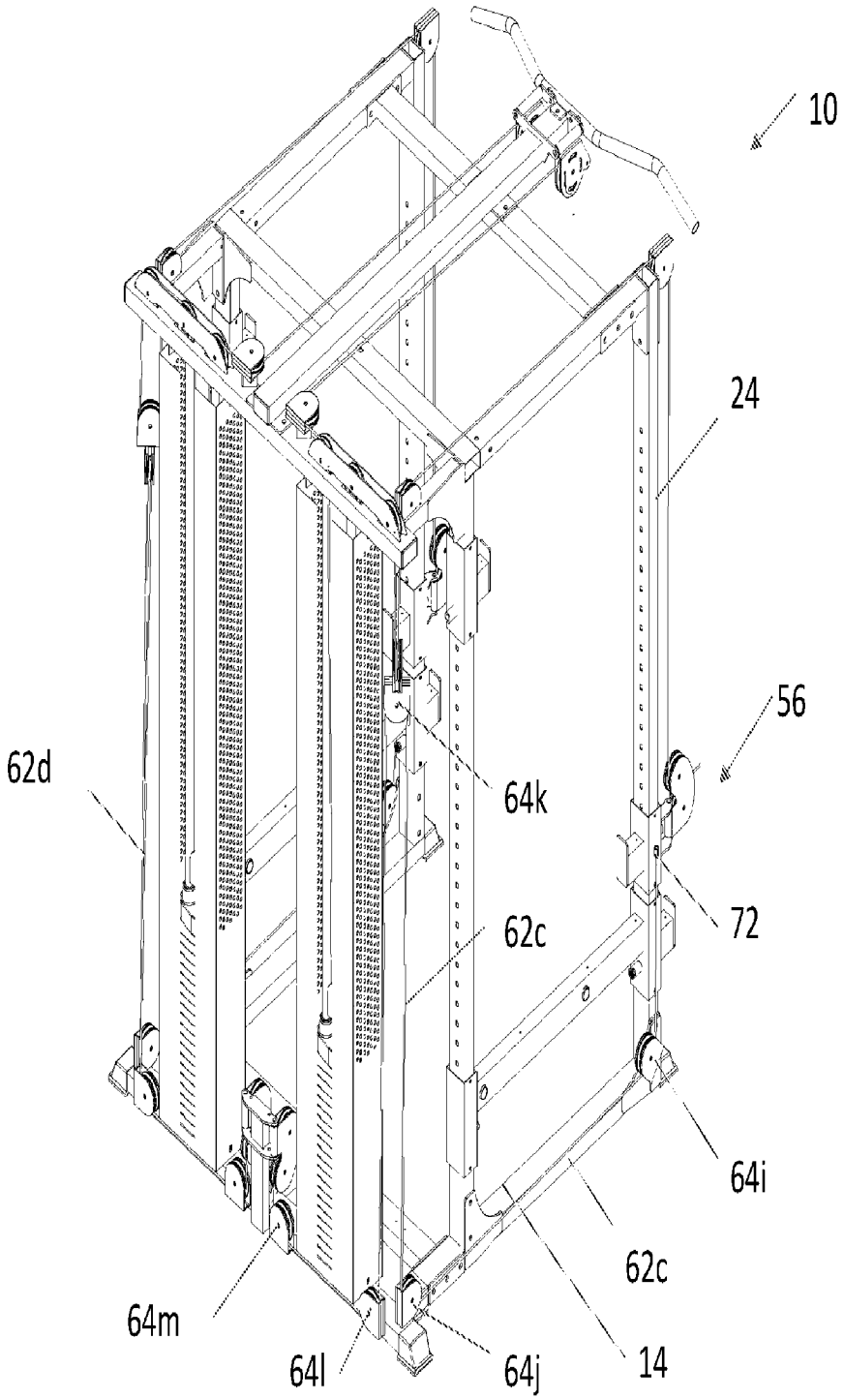
FIG. 3 is a rear perspective view of the exercise machine of FIG. 1.

FIG. 3 is a rear perspective view of the exercise machine 10. The third cable 62*c* may extend from a cable termination device 72 located on the second functional training device 56. The third cable 62*c* may extend vertically downward until engaging an eighth pulley 64*i*. The eighth pulley 64*i* may be located on or along the second vertical member 24 or the second base member 14. The third cable 62*c* may travel horizontally along the second base member 14 until engaging an ninth pulley 64*j*. The ninth pulley 64*j* may be located or on along the second base member 14 or the fourth base member 20. The third cable 62*c* may then travel vertically until engaging the tenth pulley 64*k*. The tenth pulley 64*k* may be attached to the third pulley 64*c*. The third cable 62*c* may then reverse directions and travel vertically downward until engaging an eleventh pulley 641. The eleventh pulley 64*l* may be located on or along the fourth base member 20. The third cable may then travel horizontally along the fourth base member 20 before engaging a twelfth pulley 64*m*. The twelfth pulley 64*m* may be located on or along the fourth base member 20. The cable may then terminate at or near the fourth functional training device 60. The first resistance device 66*a* may be engaged by the connection of the third pulley 64*c* which may be attached to a tenth pulley 64*k* connected to a third cable 62*c*.

A similar or identical arrangement may be located along the other side of the exercise machine 10 such that a fourth cable 62*d* travels between a cable termination device 72 located on the first functional training device 54 and the fourth functional training device 60. It is notable that as the third and fourth cable 62*c* and 62*d* may be connected to the fourth functional training device 60, a single attachment device may be connected to both the third and fourth cables 62*c* and 62*d* such that the first and second resistance device 66*a* and 66*b* are engaged when the attachment device is moved. In other exemplary embodiments, individual attachment devices may be connected to each of the third and fourth cables 62*c* and 62*d* are separately engaged when the respective attachment device is moved.

Figure 4:
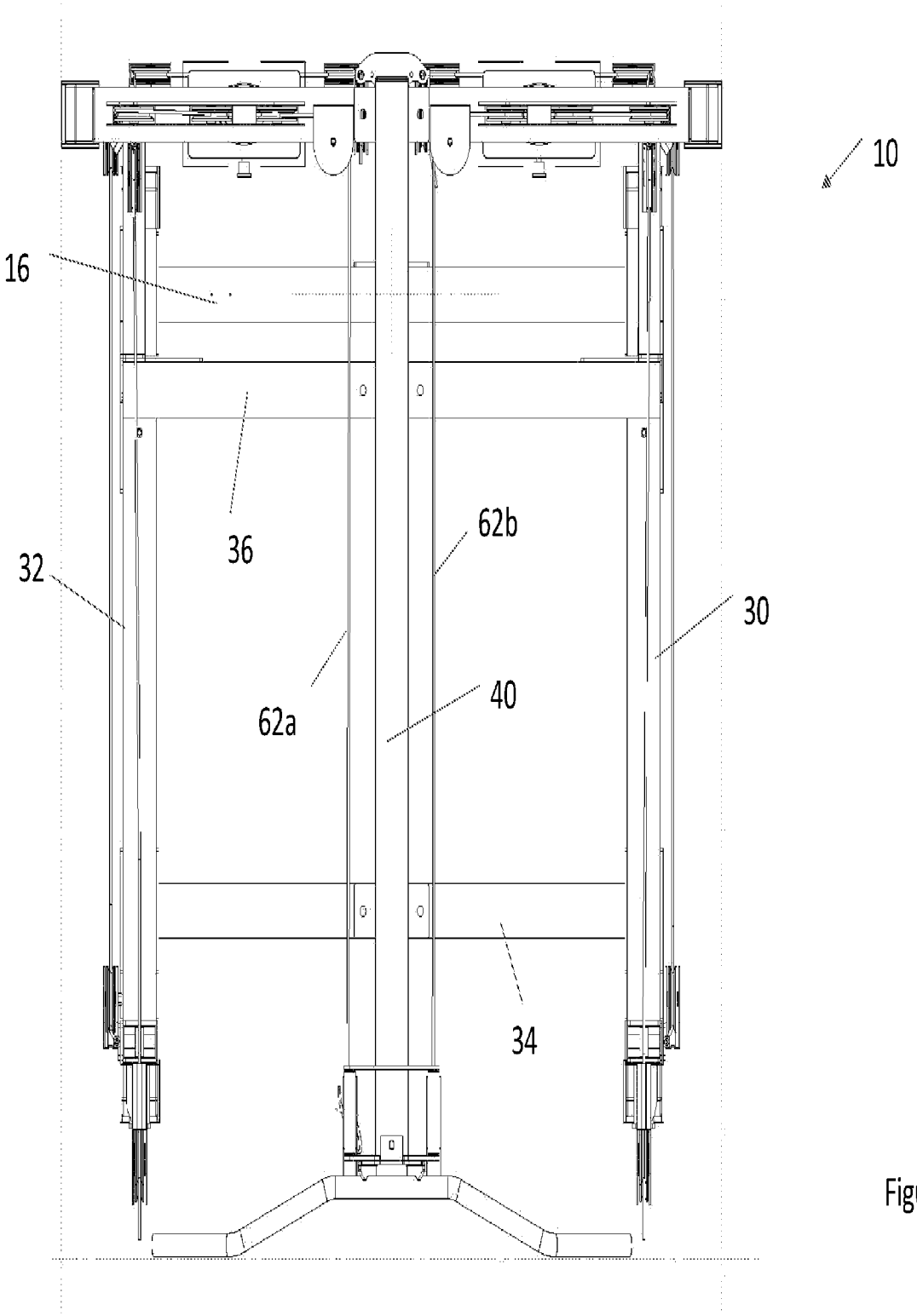
FIG. 4 is a top view of the exercise machine of FIG. 1.
Figure 5:
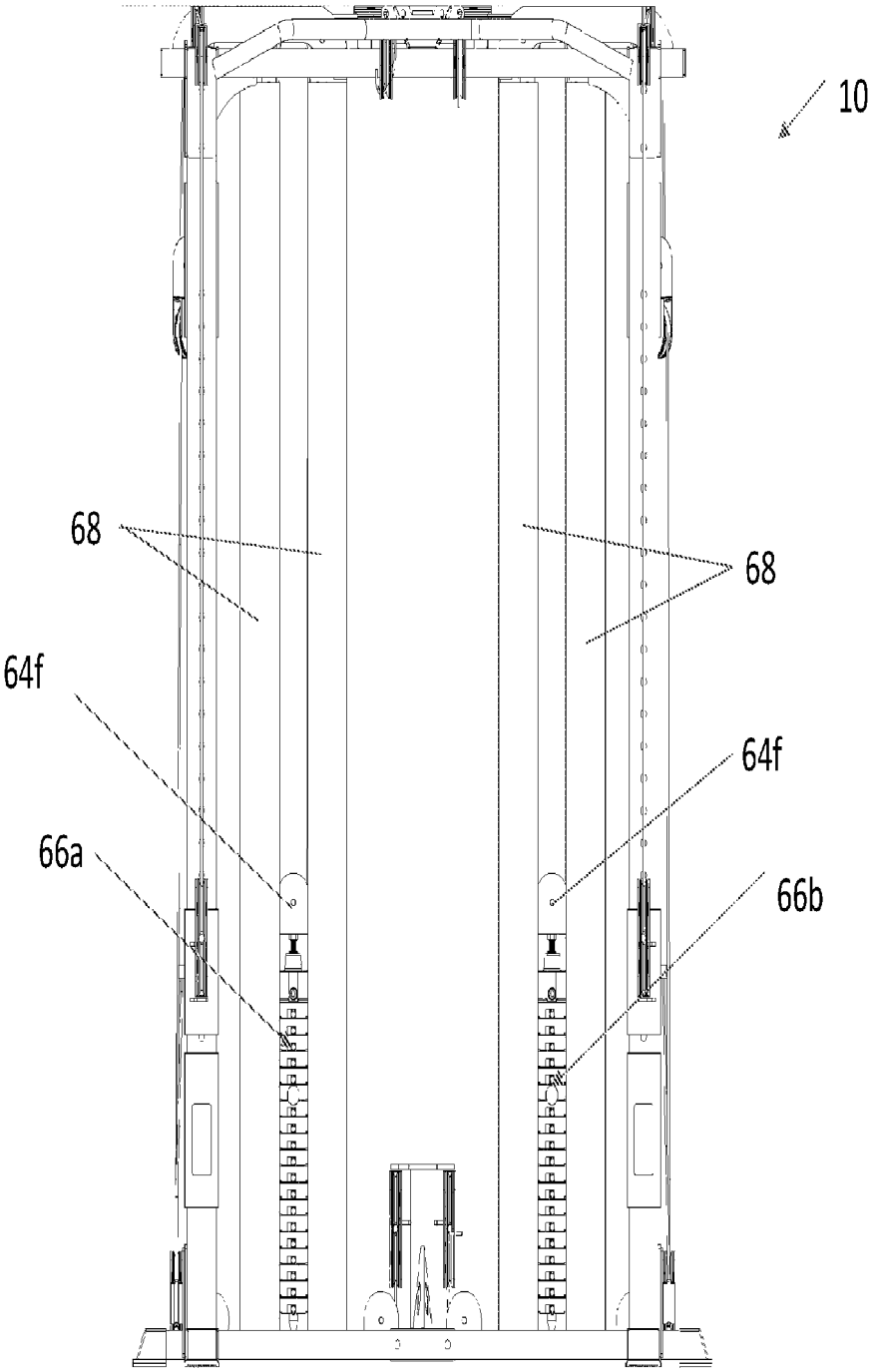
FIG. 5 is a front view of the exercise machine of FIG. 1.
Figure 6:
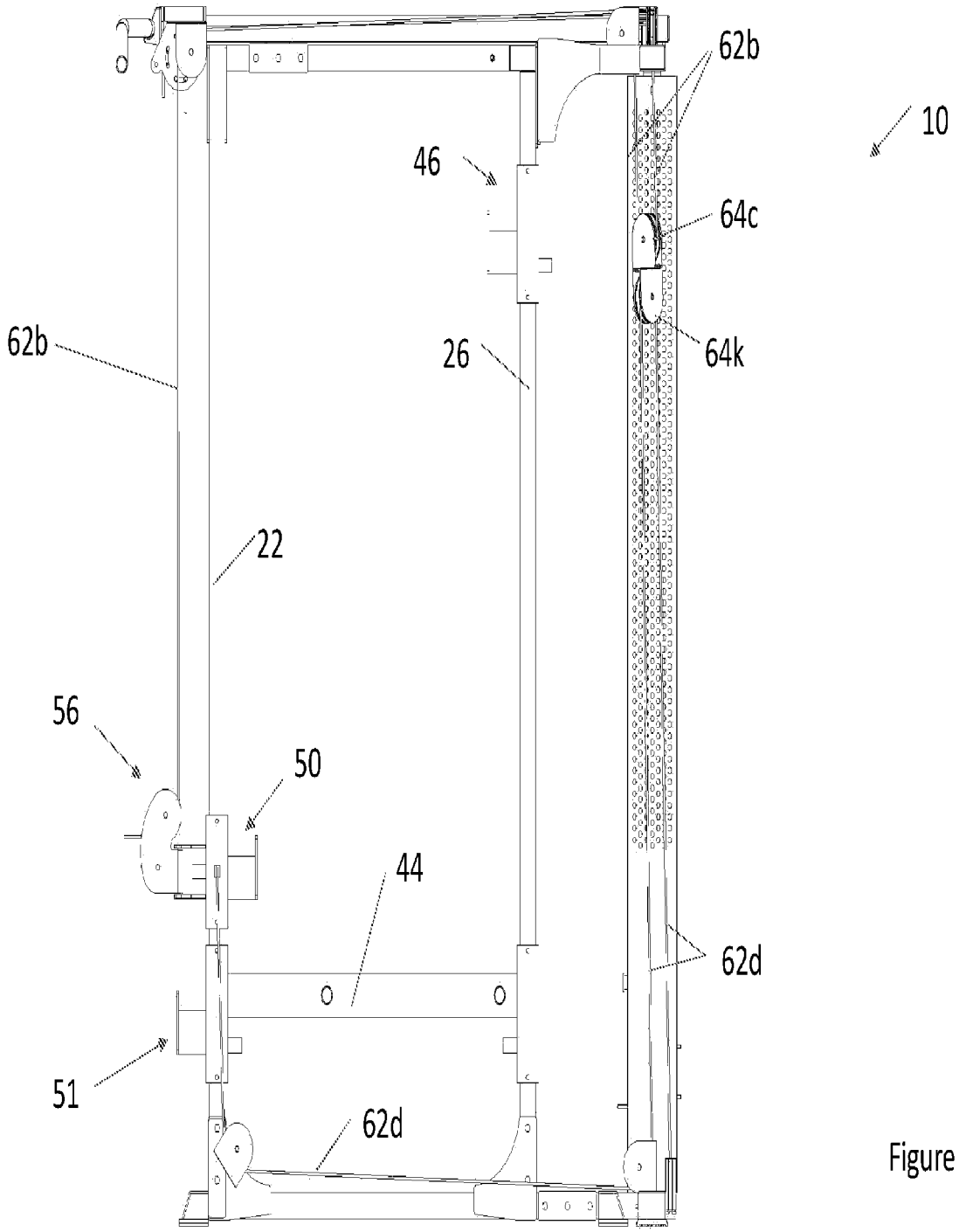
FIG. 6 is a right-side view of the exercise machine of FIG. 1.
Figure 7:
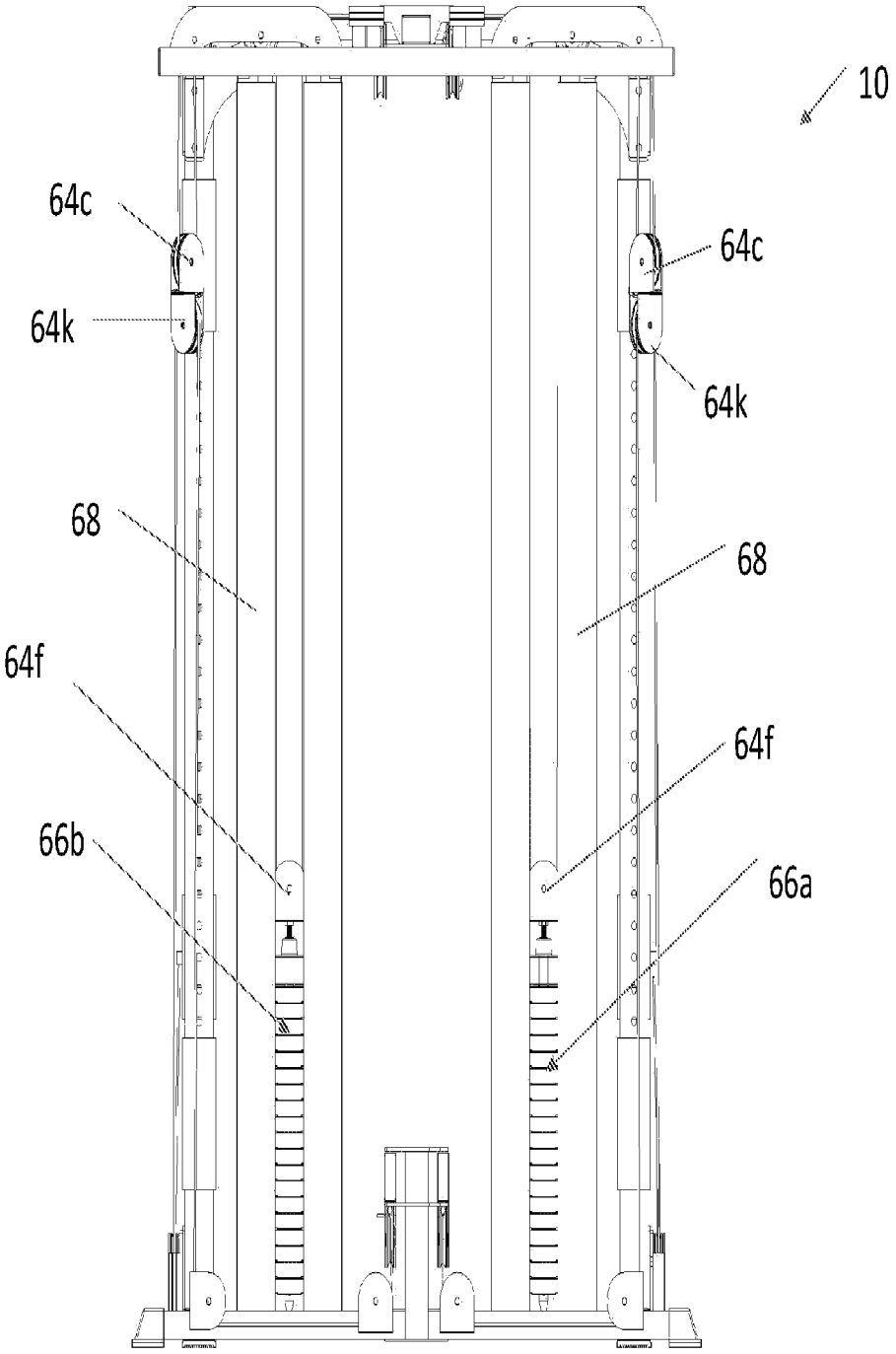
FIG. 7 is a rear view of the exercise machine of FIG. 1.

FIG. 4 is a top view of the exercise machine 10, FIG. 5 is a front view of the exercise machine 10, FIG. 6 is a right-side view of the exercise machine 10, and FIG. 7 is a rear view of the exercise machine 10. The resistance devices 66*a* and 66*b* may be a weight stack, weight plates (such as, without limitation, Olympic, or standard weight plates), an electric motor, a friction imparting mechanism, or the like. A shroud 68 may be partially or wholly surround each of the first and second resistance devices 66*a* and 66*b* together or separately.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. An exercise apparatus comprising:

a squat rack comprising a plurality of members forming a cage comprising a plurality of vertically extending members and a plurality of horizontally extending members;

a resistance device associated with said squat rack;

a cable pull device attached to one of said plurality of vertically extending members of said plurality of members, wherein said cable pull device comprises a housing and at least two pulleys located within the housing to accommodate a cable therebetween, and wherein said cable pull device is slidably attached to a first one of said plurality of vertically extending members; and said cable connecting said resistance device to said cable pull device, wherein said cable extends along one or more of said plurality of members such that sides of the cage are unobstructed by said cable.

2. The exercise apparatus of claim 1 wherein:

said plurality of vertically extending members comprise:

a first vertically extending member;

a second vertically extending member;

a third vertically extending member; and a fourth vertically extending member, each of said first, second, third, and fourth vertically extending members being spaced apart from one another; and said plurality of horizontally extending members comprise:

a first horizontally extending member extending between an upper portion of said first vertically extending member and an upper portion of said second vertically extending member;

a second horizontally extending member extending between an upper portion of said third vertically extending member and an upper portion of fourth vertically extending member;

a third horizontally extending member extending between a lower portion of said first vertically extending member and a lower portion of said second vertically extending member;

a fourth horizontally extending member extending between a lower portion of said third vertically extending member and a lower portion of said fourth vertically extending member;

a fifth horizontally extending member extending between said lower portion of said second vertically extending member and said lower portion of said fourth vertically extending member; and a sixth horizontally extending member extending between said upper portion of said second vertically extending member and said upper portion of said fourth vertically extending member, each of said first, second, third, fourth, fifth, and sixth horizontally extending members being spaced apart from one another.

3. The exercise apparatus of claim 2 further comprising:

a first safety rail extending between, and movably mounted to, said first vertically extending member and said second vertically extending member; and a second safety rail extending between, and movably mounted to, said third vertically extending member and said fourth vertically extending member.

4. The exercise apparatus of claim 2 wherein:

when said cage is viewed from a left or a right side, said cable extends at least partially within a cross sectional area between the first vertically extending member, the first horizontally extending member, the second vertically extending member, and the third horizontally extending member.

5. The exercise apparatus of claim 1 further comprising:

a second resistance device associated with said squat rack;

a second cable pull device slidably attached to a second one of said plurality of vertically extending members; and a second cable connecting said second resistance device and to said second cable pull device, wherein:

said second cable extends along one or more of said plurality of members such that the sides of the cage are unobstructed by said second cable;

said second cable pull device comprises at least two pulleys configured to accommodate said second cable therebetween;

said cable is connected to said resistance device at a first end, extends about a first portion of a floating pulley at a mid-portion, and has a second end which extends through said at least two pulleys of said cable pull device; and said second cable is connected to said second resistance device at a first end, extends about a first portion of a second floating pulley at a mid-portion, and has a second end which extends through said at least two pulleys of said second cable pull device.

6. The exercise apparatus of claim 5 further comprising:

a third cable pull device mounted to a lower one of said plurality of horizontally extending members at a location between said first resistance device and said second resistance device;

a third cable having a first end extending through said third cable pull device, a mid-portion extending about a second portion of said floating pulley, and a second end connected to said cable pull device, wherein said third cable extends along one or more of said plurality of members such that the sides of the cage are unobstructed by said third cable; and a fourth cable having a first end extending through said third cable pull device, a mid-portion extending about a second portion of said second floating pulley, and a second end connected to said second cable pull device, wherein said fourth cable extends along one or more of said plurality of members such that the sides of the cage are unobstructed by said fourth cable.

7. The exercise apparatus of claim 6 further comprising:

a fourth cable pull device mounted to a mid-portion of an upper one of said plurality of horizontally extending members;

a fifth cable having a first end connected to said resistance device and a second end extending through said fourth cable pull device, wherein said fifth cable extends along one or more of said plurality of members such that the sides of the cage are unobstructed by said fifth cable; and a sixth cable having a first end connected to said second resistance device and a second end extending through said fourth cable pull device, wherein said sixth cable extends along one or more of said plurality of members such that the sides of the cage are unobstructed by said sixth cable.

8. The exercise apparatus of claim 5 further comprising:

a first holding device provided at said cable pull device; and a second holding device provided at said second cable pull device, wherein said first and second holding devices are each configured to receive a portion of a barbell.

9. The exercise apparatus of claim 1 further comprising:

a stopper located at a distal portion of said cable located beyond said at least two pulleys and configured to frictionally engage said at least two pulleys.

10. The exercise apparatus of claim 9 further comprising:

an attachment device located at a distal portion of said cable and configured to frictionally engage said at least two pulleys.

11. The exercise apparatus of claim 1 wherein:

said resistance device comprises a weight stack.

12. The exercise apparatus of claim 1 wherein:

the cable extends along an exterior facing surface of each of the one or more of said members such that the cable is located outside of the cage and said sides of the cage are entirely unobstructed by said cable.

13. An exercise apparatus comprising:

a squat rack comprising members forming a cage for a user to perform barbell based free weight exercises within;

a first weight stack located at a rear portion of said squat rack;

a second weight stack located at said rear portion of said squat rack;

a first cable pull device comprising at least two adjacent pulleys, wherein said first cable pull device is attached to a first forward one of said members in a slidable fashion;

a second cable pull device comprising at least two adjacent pulleys, wherein said second cable pull device is attached to a second forward one of said members in a slidable fashion;

a first cable having a first end connected to said first weight stack and a second end extending through the at least two adjacent pulleys of said first cable pull device, wherein said first cable extends along at least one of said members and outside of said cage; and a second cable having a first end connected to said second weight stack and a second end extending through the at least two adjacent pulleys of said second cable pull device, wherein said second cable extends along at least one of said members and outside of said cage.

14. The exercise apparatus of claim 13 further comprising:

a first floating pulley comprising at least two pulleys, wherein said first cable extends about a first one of said at least two pulleys of said first floating pulley;

a second floating pulley comprising at least two pulleys, wherein said second cable extends about a first one of said at least two pulleys of said first floating pulley;

a third cable pull device mounted to a lower portion of said cage between said first weight stack and said second weight stack;

a third cable having a first end extending about at least one pulley of said third cable pull device, a mid-portion extending about a second one of said at least two pulleys of said first floating pulley, and a second end connected to said first cable pull device, wherein said third cable extends along at least one of said members and outside of said cage;

a fourth cable having a first end extending about at least one pulley of said third cable pull device, a mid-portion extending about a second one of said at least two pulleys of said second floating pulley, and a second end connected to said second cable pull device, wherein said fourth cable extends along at least one of said members and outside of said cage;

a fourth cable pull device mounted to an upper portion of said cage;

a fifth cable having a first end connected to said first weight stack and a second end extending about at least one pulley of said fourth cable pull device, wherein said fifth cable extends along at least one of said members and outside of said cage; and a sixth cable having a first end connected to said second weight stack and a second end extending about at least one pulley of said fourth cable pull device, wherein said sixth cable extends along at least one of said members and outside of said cage.

15. The exercise apparatus of claim 13 wherein:

said first cable pull device comprises a housing for said at least two pulleys and a carriage configured to accommodate said first forward one of said members, wherein said housing is pivotably connected to said carriage; and said second cable pull device comprises a housing for said at least two pulleys and a carriage configured to accommodate said second forward one of said members, wherein said housing is pivotably connected to said carriage.

16. The exercise apparatus of claim 13 further comprising:

a first stopper or attachment device located at or attached to a portion of said first cable extending beyond said first cable pull device and configured to prevent said portion of said first cable from retracting beyond said first cable pull device; and a second stopper or attachment device located at or attached to a portion of said second cable extending beyond said second cable pull device and configured to prevent said portion of said second cable from retracting beyond said second cable pull device.

17. An exercise apparatus comprising:

a squat rack comprising members forming a cage;

one or more resistance devices located at a rear portion of said squat rack;

a first cable pull device comprising at least two adjacent pulleys, wherein said first cable pull device is attached to a first forward one of said members in a slidable fashion;

a second cable pull device comprising at least two adjacent pulleys, wherein said second cable pull device is attached to a second forward one of said members in a slidable fashion;

a first set of one or more pulleys mounted to certain one or ones of said members;

a first cable having a first end connected to said first resistance device and a second end extending through the at least two pulleys of said first cable pull device, wherein said first cable engages the first set of one or more pulleys to extend along at least one of said members to not obstruct sides of said cage;

a second set of one or more pulleys mounted to certain one or ones of said members; and a second cable having a first end connected to said second resistance device and a second end extending through the at least two pulleys of said second cable pull device, wherein said second cable engages the second set of one or more pulleys to extend along at least one of said members to not obstruct said sides of said cage.

18. The exercise apparatus of claim 17 wherein:

the first cable extends along an outward facing surface of each of the at least one of said members such that the first cable is located outside of the cage and the sides of said cage are entirely unobstructed by said first cable; and the second cable extends along an outward facing surface of each of the at least one of said members such that the second cable is located outside of the cage and the sides of said cage are entirely unobstructed by said second cable.

19. The exercise apparatus of claim 17 wherein:

when said exercise apparatus is viewed from a left or a right side, a portion of said first cable extends within a cross sectional area defined by the members forming the left or the right side of the cage, respectively.

20. An exercise apparatus comprising:

a box rack comprising members forming a cage;

a cable pull device attached to one of said members located at a first, forward side of said cage;

a resistance device provided at a second side of said cage;

one or more cables connecting said resistance device to said cable pull device; and pulleys, each attached to one of said members, wherein said one or more cables engage said pulleys such that said one or more cables are routed along one or more of said members such that at least the first side, a third side, and a fourth side of the cage are unobstructed by said one or more cables.

21. The exercise apparatus of claim 20 wherein:

the cable pull device is configured to be selectively repositioned along said one of said members; and the resistance device is mounted to a horizontally extending one of said members and comprises a weight stack configured for sliding vertical movement.

22. The exercise apparatus of claim 21 wherein:

said second side is opposite said first side and located at a rear side of said cage;

said third side is located at a left side of said cage; and said fourth side is located at a right side of said cage.

23. The exercise apparatus of claim 22 wherein:

when said exercise apparatus is viewed from said third side or said fourth side, a portion of at least one of said one or more cables extends within a cross sectional area defined by the members forming the third side or said fourth side of the cage, respectively.

24. The exercise apparatus of claim 20 wherein:

the pulleys route said one or more cables along exterior facing surfaces of the one or more of the members such that the one or more cables are located outside of the cage and at least the first side, the third side, and the fourth side of the cage are entirely unobstructed.

* * * * *